US005868561A

United States Patent [19]

Rogelet

[11] Patent Number: 5,868,561

[45] Date of Patent: Feb. 9, 1999

[54] GAS LIGHTER COMPRISING A SAFETY IGNITION SYSTEM

[75] Inventor: Thierry Rogelet, Lyon, France

[73] Assignee: Cricket S.A., Rillieux-la-Pape, France

[21] Appl. No.: 979,829

[22] Filed: Nov. 24, 1997

[30] Foreign Application Priority Data

Dec. 12, 1996 [FR] France ..... 96 15529

[51] Int. Cl.[6] ..... F23Q 1/02

[52] U.S. Cl. ..... 431/153; 431/277

[58] Field of Search ..... 431/277, 153; 192/26, 28, 79

[56] References Cited

U.S. PATENT DOCUMENTS

| | | | |
|---|---|---|---|
| 5,002,482 | 3/1991 | Fairbanks et al. | 431/153 |
| 5,096,414 | 3/1992 | Zellweger | 431/277 |
| 5,125,829 | 6/1992 | McDonough et al. | 431/277 |
| 5,547,370 | 8/1996 | Hwang | 431/277 |
| 5,601,491 | 2/1997 | Chan et al. | 192/56.1 |
| 5,634,787 | 6/1997 | Frigiere | 431/277 |

OTHER PUBLICATIONS

WO 93/17282, Frigiere, Sep. 1993.
WO 95/04247, McDonough et al, Feb. 1995.

*Primary Examiner*—Carl D. Price

*Attorney, Agent, or Firm*—Oliff & Berridge, PLC

[57] ABSTRACT

This lighter (1) of the type comprising a reservoir for containing liquefied petroleum gas, a valve (3) mounted on the reservoir and permitting the gas to leave the same, a valve opening mechanism (4,5), as well as an ignition system comprising a flint (6) co-operating with a spark wheel (7) rotationally operated by at least one circular operating wheel (10) mounted co-axially with the spark wheel. This lighter is characterised in that each operating wheel is independent of the spark wheel and can pivot about its own axis independently of the spark wheel, and in that the axle is fixed to the spark wheel and comprises on its periphery zones which are concave and/or convex in transverse cross section, whereas the operating wheel comprises, in the region of its holes which enables its engagement on the axle, convex and/or concave zones, which are formed to slide with respect to the concave and/or convex zones of the axle when the force exercised on the operating wheel to ignite the lighter is below a threshold force, but engage with them when the force exercised is above the threshold force, and the largest cross sectional dimension of the axle is less than the smallest cross sectional dimension of die hole of the operating wheel, to permit the significant radial displacement of the operating wheel with respect to the axle and, below the said threshold force to permit the aid pivoting movement of the operating wheel with respect to the axle.

6 Claims, 2 Drawing Sheets

GAS LIGHTER COMPRISING A SAFETY IGNITION SYSTEM

BACKGROUND OF THE INVENTION

The present invention relates to a gas lighter comprising a safety ignition system, also referred to as a "child resistant" lighter, that is to say can not be ignited by a child of less than five years old.

A gas lighter generally comprises a reservoir for containing liquefied petroleum gases, a valve mounted on the reservoir permitting gas to leave the reservoir, an opening and closing system for the release of gas operated by a lever, a system of regulation of the release of gas as well as the ignition system. In a known way, the ignition system comprises a pyrophoric flint co-operating with a spark wheel and the lighter also comprises a protective cap. The spark wheel is mounted on an axis between two operating wheels which are attached to it. The spark wheel has a cylindrical shape and each of the operating wheels comprises a disk having a diameter slightly greater than that of the spark wheel. The rims of the operating wheels comprise unevennesses which make then rough. Thus, a user can easily operate the spark wheel with a finger, because the finger does not slide on the operating wheels.

When the spark wheel, being in contact with the flint, is rotated by operation of the operating wheels by a digit of the user, a spray of sparks is created and is followed by the action of the same digit against the gas opening lever which releases a quantity of gas. The spray of sparks ignites the gas, producing a flame which forms above the cap.

Such a system requires a positive action on the part of the user to produce aid maintain a flame and requires two independent movements one after the other—rotation of the spark wheel and action on the gas opening lever—to produce a flame.

However, it is desirable to increase the difficulty of operating such lighters so that children younger than five years old are not able to produce a flame with such lighters.

Lighters already exist providing a supplementary difficulty which must be overcome to produce a flame and several patents or patent applications describe such lighters. For example, patents U.S. Pat. No. 5,125,829, U.S. Pat. No. 5,002,482 or international patent applications WO 93/17282, WO 95/04247.

Most of the lighters described in these documents comprise, compared to conventional lighters, a supplementary device making access to the operating wheels of the spark wheel more difficult, or by blocking movement of the gas opening lever.

In this way, these lighters comprise a complex structure involving an increased cost of manufacture. Furthermore, the use of some of these lighters is complicated and requires a particular method of use. Even adults can find several difficulties in the operation of such lighters and/or need preliminary instructions.

U.S. Pat. No. 5,096,414 concerns a lighter which does not contain operating wheels fixed to the spark wheel, but two flat discs having a diameter greater than that of the spark wheel, and freely mounted to rotate about an axis corresponding to that of the spark wheel. In this case operation of the spark wheel is achieved directly by the flesh of the digit of the user, after deformation between the two free discs.

In a similar system, the axis of the spark wheel comprises a polygonal section, and the operating wheels comprise corresponding holes of polygonal cross section, which co-operate with the axis. These polygonal sections permit the rotational connection of the operating wheels and the spark wheel when a sufficient radial pressure is exercised on the operating wheels. A disadvantage of this system is that it results in the rapid wear on the flats of the axle and the holes such that the operation of the operating wheels becomes more and more difficult with time. Moreover, the force exercised on the operating wheels is difficult to control. Furthermore, this force has to be applied in a perfectly radial manner in order for the operation of the spark wheel to take place, which necessitates the application of increased pressure by the user.

An objective of the present invention is to provide a lighter which is easily operated by an adult, but very difficult to use by a child especially a child of less than five years old, and which remedies the disadvantages of the prior art lighters.

Another objective of the invention is to provide a reliable security system which is inviolable and constant in operation throughout the life of the lighter.

Another objective of the invention is to have the functioning of the lighter as close as possible to the functioning of a traditional lighter, in which the "unblocking" action is realized in the same place as the ignition action, in such a way that the user has no need either for preliminary instructions or practice in order to operate the lighter.

SUMMARY OF THE INVENTION

To this end, the lighter concerned is of the type comprising a reservoir for containing a liquefied petroleum gas, a valve mounted on the reservoir and permitting gas to leave the reservoir, a mechanism for opening the valve, as well as an ignition system comprising a flint co-operating with a spark wheel rotationally operable by at least one circular operating wheel mounted co-axially with the spark wheel, and characterised in that each operating wheel is independent of the spark wheel and can pivot about its own axis independently of the spark wheel, and in that an axle is fixed to the spark wheel and comprises on its periphery zones which are concave and/or convex in transverse cross section, whereas the operating wheel comprises, in the region of its holes enabling its engagement on the axle, convex and/or concave zones, which are formed to slide with respect to the concave and/or convex zones of the axle when the force exercised on the operating wheel to ignite the lighter is below a threshold force, but engage with them when the force exercised is above the threshold force, and in that the largest cross sectional dimension of the axle is less than the smallest cross sectional dimension of the hole of the operating wheel, to permit the significant radial displacement of the operating wheel with respect to the axle as well as to permit the pivoting movement of the operating wheel with respect to the axle when a force below the threshold force is exercised on the operating wheel.

The round form of the zones described above assists the sliding of the operating wheel with respect to the axle, such that the threshold force is relatively high and higher than the force that can be operated on the operating wheel by a child of less than five years of age. Similarly in the case of rotational manipulation of the operating wheels, no rotational connection can normally be achieved between the operating wheel and the axle, and in this way the lighter according to the invention provides perfect security.

This lighter is easy to use by an adult because the rotational connection between the operating wheel and the spark wheel can be created even when the force exercised on the operating wheel is not purely radial.

According to one embodiment of the invention, the concave and/or convex zones of the axle and of the operating wheel are connected to each other by curved transition zones. These curved transition zones assist the sliding of the operating wheel with respect to the axle of the spark wheel at forces below the said threshold force, and therefore reinforce the safety provided by the lighter of the invention. Furthermore the wear on the axle and the operating wheel is limited.

BRIEF DESCRIPTION OF THE DRAWINGS

The invention will now be described in more detail in the form of the following non limiting exemplary embodiments of the lighter which it concerns together with the following drawings, in which.

DESCRIPTION OF THE SPECIFIC EMBODIMENTS

Figure 1:
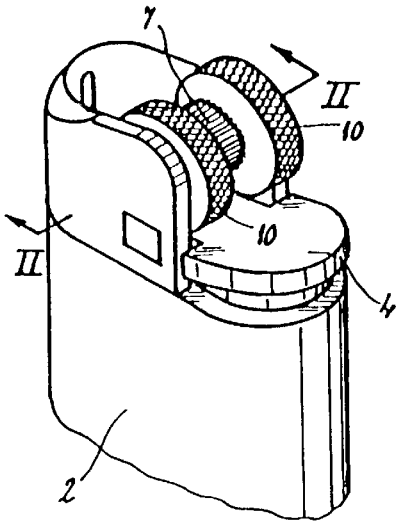
FIG. 1 is a perspective view of the upper part a first lighter.
Figure 2:
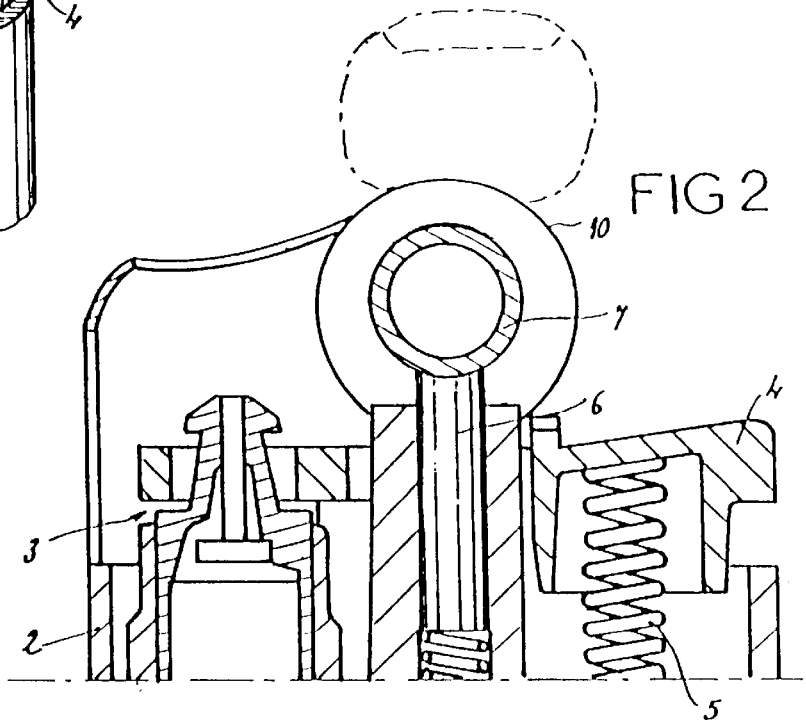
FIG. 2 is a longitudinal transverse cross sectional view through the middle.

The lighter shown in FIG. 1 comprises a body forming a reservoir for containing a liquefied petroleum gas. The upper part of the reservoir is provided with a valve 3 normally maintained closed, and actionable towards its open position by a lever 4. This lever 4 is normally maintained in the closed position of the valve by the action of a spring 5. The ignition system of the lighter comprises a flint 6 susceptible to providing sparks under the action of rubbing exercised by a spark wheel 7. This spark wheel is pivotally mounted about an axle 8 engaged for example in orifices (not shown) provided in the ears of the lighter.

On each side of the spark wheel 7 two operating wheels 10 are arranged.

Figure 3:
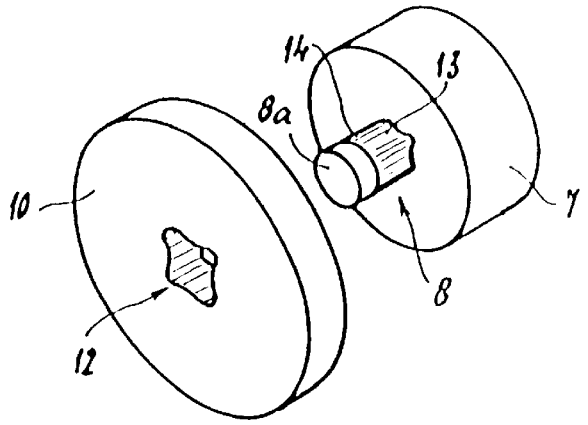
FIG. 3 is a simplified view in large scale, in perspective of the spark wheel and of a operating wheel which comprise the lighter.

As shown in FIG. 3, each operating wheel 10 is independent of the spark wheel 7 and comprises a circular ring independent of the spark wheel 7, and comprises a central hole 12 to enable its assembly on the axle 8 of the spark wheel 7.

Figure 4:
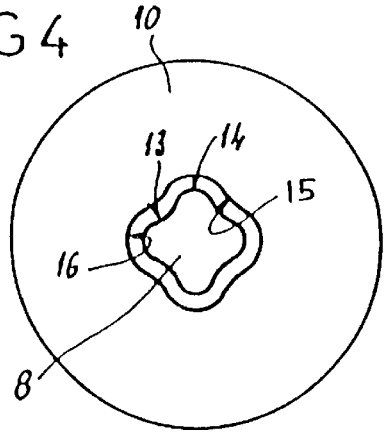
FIG. 4 is an axial view of this spark wheel and this operating wheel.

Referring now to FIGS. 3 and 4, it is shown that the axle 8 comprises four concave zones 13 defining radial hollows regularly arranged on its circumference. These concave zones define successive radial bosses 14 between to which they are connected by curved transition zones.

The operating wheel 10 comprises for its part, arranged at its wall defining the hole 12, convex zones 15 projecting radially towards the inside, and arranged in a regular manner on its circumference. These zones 15 define successive radial hollows 16, to which they are connected by curved transition zones.

The smallest transverse dimension of the hole 12 (that is the distance separating two convex zones 15 from each other) is greater than the largest dimension of the axle 8 in cross section (that is the distance separating the summit of the opposing bosses 14). The operating wheel 10 can also pivot independently of the spark wheel about the axle and can be displaced radially with respect to the lighter.

This succession of convex and concave zones 13 to 16 provides a sliding effect of the operating wheel 10 with respect to the axle 8 when the force exercised on the operating wheel is below the threshold force, this threshold force being relatively high and being significantly above the force that can be exercised on the operating wheel by a child of less than five years of age.

The curved transition zones assist the sliding of the operating wheel 10 with respect to the axle 8 below the prescribed threshold force, and limit the wear on the axle and on the operating wheel.

Moreover, this lighter remains easy to use by an adult due to the fact that the rotational connection between the operating wheel and the spark wheel can be created even when the force exercised on the operating wheel is not purely radial.

Figure 5:
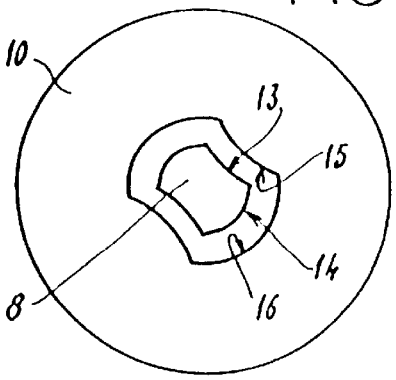
FIGS. 5 to 7 are similar views to FIG. 4 of three further embodiments of the invention.

FIG. 5 shows a further embodiment of the lighter of the invention. To aid understanding, the elements already described in reference to FIGS. 1 to 4 and which are found in this embodiment, as well as those shown in FIGS. 6 and 7, are designated by the same reference numerals.

In the case of FIG. 5, the axle 8 comprises only two concave zones 13 and two bosses 14, whereas the operating wheel 10 comprises two convex zones 15 and a hollow 16, the transition zones between these different zones not being curved but being formed by internal and external angles.

Figure 6:
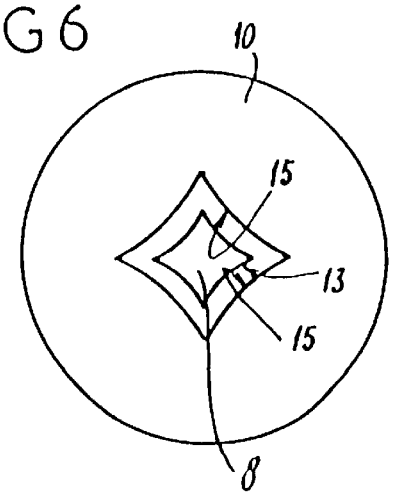

In the case of the embodiment shown in FIG. 6, the axle comprises four concave zones 13 and the operating wheel 10 comprises four corresponding convex zones 15, similar to the embodiment shown in FIG. 4. The different zones are not connected by curved transition zones but by internal and external angles.

Figure 7:
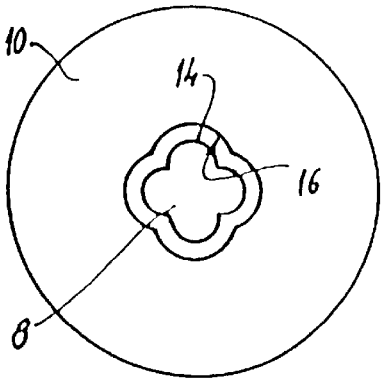

In the embodiment shown in FIG. 7, the axle 8 comprises four projecting convex zones 14, whereas the operating wheel comprises four corresponding concave zones 16, these different zones being similarly separated by internal and external angles. In each of the embodiments in FIGS. 5, 6 and 7 the angles are shown as acute angles.

As it has been shown above, the invention provides a big improvement on the existing techniques by providing a lighter with a security ignition system preventing its use by young children but nevertheless easy to use by an adult allowing them to exercise a force which is not entirely radial, on the ignition system and thus enabling operation of the lighter. The concave and convex forms permit the force of an adult's finger exercised on the operating wheel to be established to rotationally operate the spark wheel.

It will be appreciated that the invention is not limited to the specific embodiments described above, but that it includes all the various possible embodiments. Thus the number of zones described is not limited to four a larger number being possible without being outside the scope of the invention.

What I claim is:

1. A gas lighter for use with liquefied petroleum gas, comprising:

a reservoir for containing liquefied petroleum gas, a valve mounted on the reservoir and permitting gas to leave the reservoir, a mechanism for opening the valve, and an ignition system including an axle and a flint co-operating with a spark wheel rotationally operable by at least one circular operating wheel mounted coaxially with the spark wheel, the at least one operating wheel having an axis, being independent of the spark wheel and pivotable about the axis independently of the spark wheel, the axle being fixed to the spark wheel, a cross section of a periphery of the axle defining at least one concave zone and at least one convex zone, the at least one operating wheel defining a hole engageable with the axle, a perimeter of the hole defining at least one concave zone and at least one convex zone which are formed to slide with respect to the at least one concave zone and the at least one convex zone of the periphery of the axle when a force exercised on the at least one operating wheel to ignite the lighter is below a threshold force, but engage with the at least one concave zone and the at least one convex zone of the periphery of the axle when the force exercised on the at least one operating wheel is above the threshold force, and a maximum diameter of the cross section of the periphery of the axle being less than a minimum diameter of the hole of the at least one operating wheel, to permit significant radial displacement of the at least one operating wheel with respect to the axle as well as to permit the pivoting movement of the at least one operating wheel with respect to the axle when the force exercised on the at least one operating wheel is below the threshold force.

2. The gas lighter according to claim 1, wherein the at least one concave zone and the at least one convex zone of the periphery of the axle, and the at least one concave zone and the at least one convex zone of the perimeter of the hole of the operating wheel, are connected to each other by curved transition zones.

3. The gas lighter according to claim 1, wherein the periphery of the axle defines four concave zones forming radial hollows regularly arranged on the periphery of the axle, the four concave zones defining successive radial bosses between them, the four concave zones being connected to the radial bosses by curved transition zones, the perimeter of the hole of the at least one operating wheel defining convex zones projecting radially towards a center of the hole and arranged in a regular manner on the perimeter of the hole the convex zones forming successive radial hollows between them, the convex zones being connected to the radial hollows by curved transition zones.

4. The gas lighter according to claim 1, wherein the periphery of the axis only defines two concave zones and two bosses, whereas the perimeter of the hole of the at least one operating wheel defines two convex zones and a hollow, and transition zones between the different zones being formed by internal and external angles.

5. The gas lighter according to claim 1, wherein the periphery of the axle defines four concave zones and the perimeter of the hole of the at least one operating wheel defines four corresponding convex zones, the different zones being connected by internal and external angles.

6. The gas lighter according to claim 1, wherein the periphery of the axle defines four projecting convex zones, whereas the perimeter of the hole of the operating wheel defines four corresponding concave zones, and transition zones between the different zones being separated by internal and external angles.

* * * * *